US005926923A

United States Patent [19]

Smith

[11] Patent Number: 5,926,923

[45] Date of Patent: Jul. 27, 1999

[54] TIE RETAINING DEVICE

[76] Inventor: Albert E. Smith, 225 E. 16th St., Mishawaka, Ind. 46544

[21] Appl. No.: 08/944,808

[22] Filed: Oct. 6, 1997

[51] Int. Cl.[6] ..... A41D 25/04

[52] U.S. Cl. ..... 24/66.2; 24/66.4; 24/66.5; 24/66.13

[58] Field of Search ..... 2/137, 138, 145, 2/336, 341; 24/49.1, 66.13, 66.5, 66.4, 66.2, 710.8, 357, 56, 60, 666, 667, 342.1; D11/202–205

[56] References Cited

U.S. PATENT DOCUMENTS

| | | | |
|---|---|---|---|
| 309,659 | 12/1884 | Smith . | |
| 345,935 | 7/1886 | Thal . | |
| 678,098 | 7/1901 | Bummert . | |
| 718,218 | 1/1903 | Reibetanz | 24/710.8 |
| 745,445 | 12/1903 | Von Köppen . | |
| 869,683 | 10/1907 | Balla, et al. . | |
| 907,398 | 12/1908 | Perrilliat . | |
| 970,931 | 9/1910 | Kramer | 24/667 |
| 1,060,438 | 4/1913 | Dorney . | |
| 1,290,368 | 1/1919 | Schwartz . | |
| 1,358,244 | 11/1920 | Presley . | |
| 1,531,969 | 3/1925 | Mitchell . | |
| 1,573,885 | 2/1926 | Weisbaum . | |
| 1,647,407 | 11/1927 | Hostetter . | |
| 1,737,632 | 12/1929 | Audet . | |
| 1,909,280 | 5/1933 | Kepley . | |
| 2,000,127 | 5/1935 | Desrosiers . | |
| 2,013,061 | 9/1935 | Loewinsohn . | |
| 2,060,040 | 11/1936 | Cobb . | |
| 2,068,454 | 1/1937 | Helske . | |
| 2,121,402 | 6/1938 | Knoebel, Jr. . | |
| 2,168,946 | 8/1939 | Rogers . | |
| 2,181,443 | 11/1939 | Zeman . | |
| 2,384,694 | 9/1945 | Quin . | |
| 2,430,952 | 11/1947 | Sawinski . | |
| 2,465,787 | 3/1949 | Bliek . | |
| 2,592,155 | 4/1952 | Johnson . | |
| 2,636,179 | 4/1953 | Churchill . | |
| 2,682,284 | 6/1954 | Oder | 24/357 X |
| 2,755,530 | 7/1956 | Martin . | |
| 2,893,086 | 7/1959 | Parker | 24/66.6 |
| 3,019,445 | 2/1962 | Hirsch et al. . | |
| 3,116,525 | 1/1964 | Koby . | |
| 3,793,681 | 2/1974 | Casstevens, Jr. et al. | 24/66.13 X |
| 3,942,192 | 3/1976 | Harris . | |
| 3,968,544 | 7/1976 | Sinclair . | |
| 4,099,300 | 7/1978 | Wolak . | |
| 4,686,716 | 8/1987 | Burns . | |
| 4,839,945 | 6/1989 | Price et al. . | |
| 5,031,284 | 7/1991 | Ray . | |
| 5,046,221 | 9/1991 | Walker . | |
| 5,097,569 | 3/1992 | Erickson . | |
| 5,235,730 | 8/1993 | Townsend . | |

FOREIGN PATENT DOCUMENTS

| | | | |
|---|---|---|---|
| 403922 | 6/1909 | France | 24/56 |
| 181112 | 1/1906 | Germany | 24/56 |
| 468364 | 12/1952 | Italy | 24/710.8 |
| 712872 | 8/1954 | United Kingdom . | |

*Primary Examiner*—James R. Brittain
*Attorney, Agent, or Firm*—Barnes & Thornburg

[57] ABSTRACT

A tie retaining device according to the present invention includes a fastener part having a front side and a back side, the front side supporting a pair of opposed, laterally projecting barbs, and the back side including an eyelet. The retaining device also includes a retainer clip having an opening for receiving a button of a shirt to secure the retainer clip to the shirt, and a prong for removably coupling with the eyelet of the fastener part. The fastener part barbs are inserted into the rear, folded back flaps of a tie body to attach the fastener part to the tie. The narrow tie tail is then inserted through an elongated opening in the fastener part. The eyelet on the back side of the fastener part is then threaded onto the prong of the retainer clip. In an alternate embodiment, the retainer clip is replaced by a retainer chain which is attached at one end to the center of a rod, and at the other end to a clasp. The rod is threaded into a shirt button hole to secure the retainer chain to the shirt, and the clasp is coupled to the eyelet to connect the fastener part to the retainer chain.

34 Claims, 3 Drawing Sheets

TIE RETAINING DEVICE

BACKGROUND AND SUMMARY OF THE INVENTION

The present invention relates to a removable device for securing a tie to the front of a shirt, and retaining the tie in a substantially,centered, straight-down position.

Many men wear neckties which, as a result of wind or movement of the wearer, tend to separate, flip over the man's shoulder, or twist. Such unrestrained movement is annoying and unattractive. Additionally, unrestrained neckties are more likely to be damaged. As the wearer bends forward, such as to reach across a table, the necktie may fall into food or liquids.

One embodiment of the present invention provides a tie retaining device which includes a retainer clip and a fastener part. The fastener part forms an elongated ring with a front side and back side. The front side supports a pair of opposed, laterally projecting barbs. The back side includes an eyelet. The barbs are inserted into the rear flaps of the main tie body and the tie tail is threaded through the narrow opening in the elongated ring. The retainer clip includes a flat rear part with a slot for sliding onto one of the shirt buttons, thereby securing the retainer clip to the shirt. The retainer clip also includes an upturned prong for removably coupling with the fastener part eyelet. Once the retainer clip is attached to the button, the eyelet of the fastener part is threaded onto the retainer clip prong, thereby retaining the tie adjacent the shirt in a centered, straight-down position.

According to another embodiment of the present invention, a retainer chain is substituted for the retainer clip. The chain has a clasp on one end for removably coupling to the fastener part eyelet and a rod on the other end for insertion into a button hole. Unlike the retainer clip, the retainer chain permits some movement of the tie.

Other features of the present invention will be apparent upon consideration of the following description of exemplary embodiments and the accompanying drawings.

DETAILED DESCRIPTION OF EMBODIMENTS OF THE INVENTION

The embodiments described herein are not intended to be exhaustive or to limit the invention to the precise forms disclosed. Rather, the embodiments selected for description are disclosed so that others skilled in the art may use their teachings.

Figure 1:
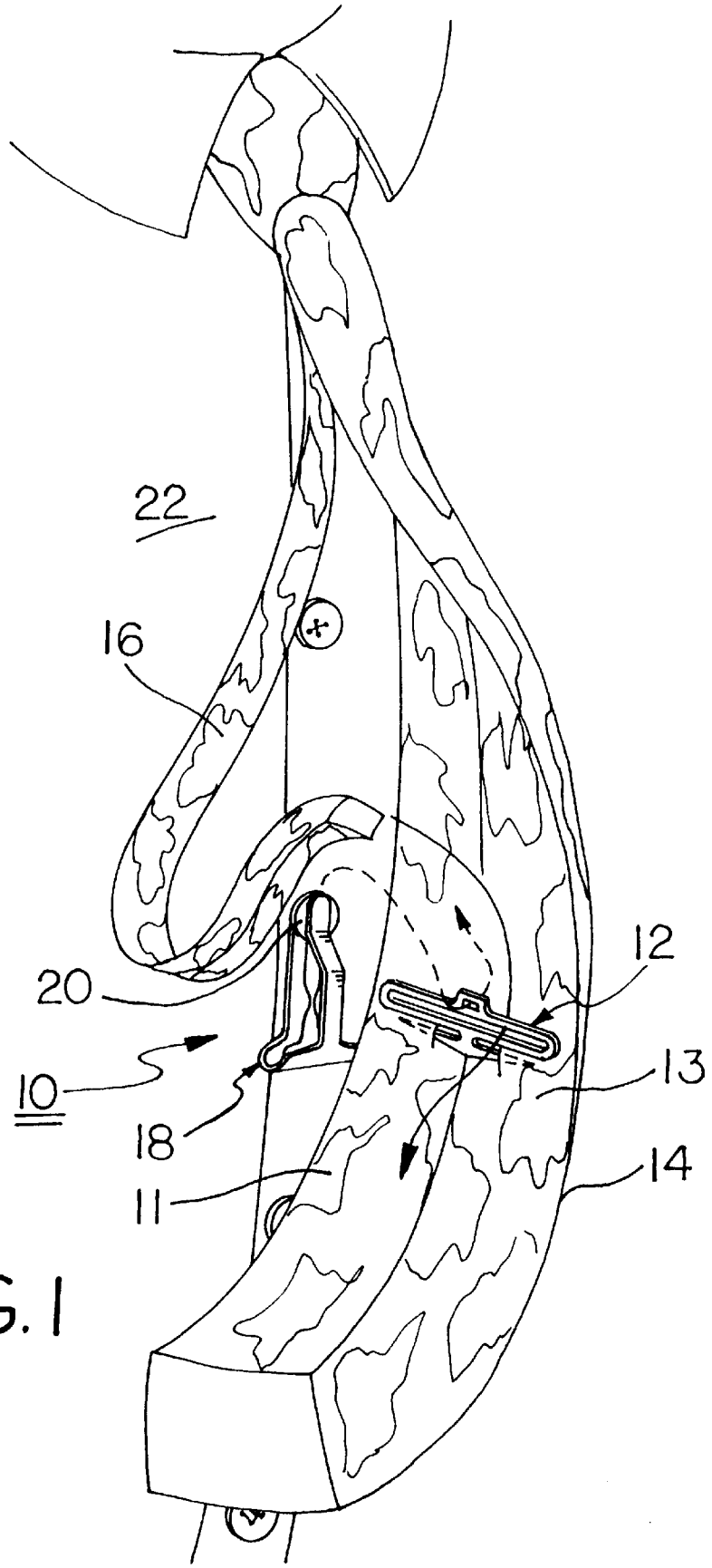
FIG. 1 is a perspective view of a tie retaining device according to the present invention.

FIG. 1 shows a tie retaining device according to the present invention, generally designated 10. Device 10 generally includes a fastener part 12 for attachment to the folded back flaps 11, 13 of the main tie body 14, and a retainer clip 18 for attachment to a selected button 20 of a shirt 22.

Figure 2:
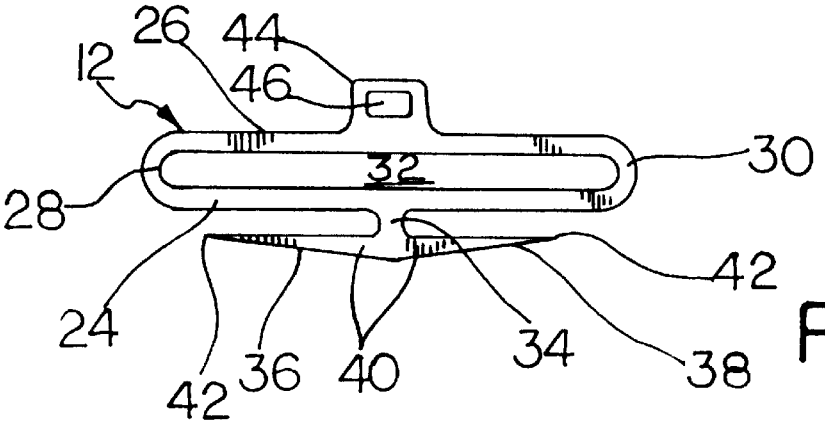
FIG. 2 is a top plan view of a fastener part according to the present invention.

Referring now to FIG. 2, fastener part 12 includes a front side 24, a back side 26, and a pair of end segments 28, 30, collectively defining an elongated, narrow opening 32. Front side 24 includes an arm 34 which carries a pair of opposed, laterally projecting barbs 36, 38. Each barb includes a first end 40 connected to arm 34, and a second end 42. In one embodiment, barbs 36, 38 taper from one width at their first ends 40 to a point at their second ends 42. The back side 26 of fastener part 12 includes an eyelet 44 which includes an eyelet opening 46.

Figure 3:
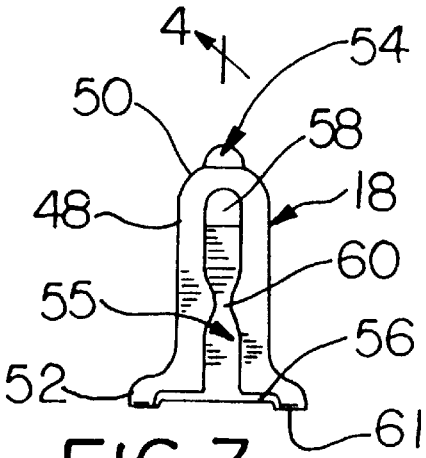
FIG. 3 is a rear elevational view of a retainer clip according to the present invention.
Figure 4:
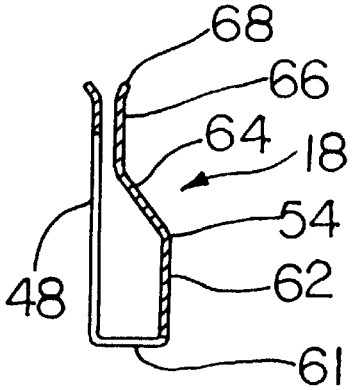
FIG. 4 a cross-sectional view taken substantially along line 4—4 of FIG. 3.

FIGS. 3 and 4 show a retainer clip 18 according to the present invention. Retainer clip 18 is shown as a one-piece construction, including a flat rear part 48 with an upper end 50 and a lower end 52, and a prong 54. Rear part 48 includes an opening or slot, generally designated 55, for receiving a button 20. Button-receiving opening 55 includes an inlet portion 56 having a wide dimension to accommodate the diameter of button 20, a closed portion 58 adjacent upper end 50 of rear part 48, and a constricting portion 60 with a reduced dimension between upper end 50 and lower end 52.

A web 61 connects rear part 48 to prong 54. Prong 54 includes a first segment 62 which is spaced away from and substantially parallel to rear part 48, a second segment 64 which converges toward rear part 48, a third segment 66 which is adjacent rear part 48 relative to the first segment 62, and a fourth part 68 which diverges slightly away from rear part 48 to receive eyelet 44 as described in greater detail herein.

Figure 5:
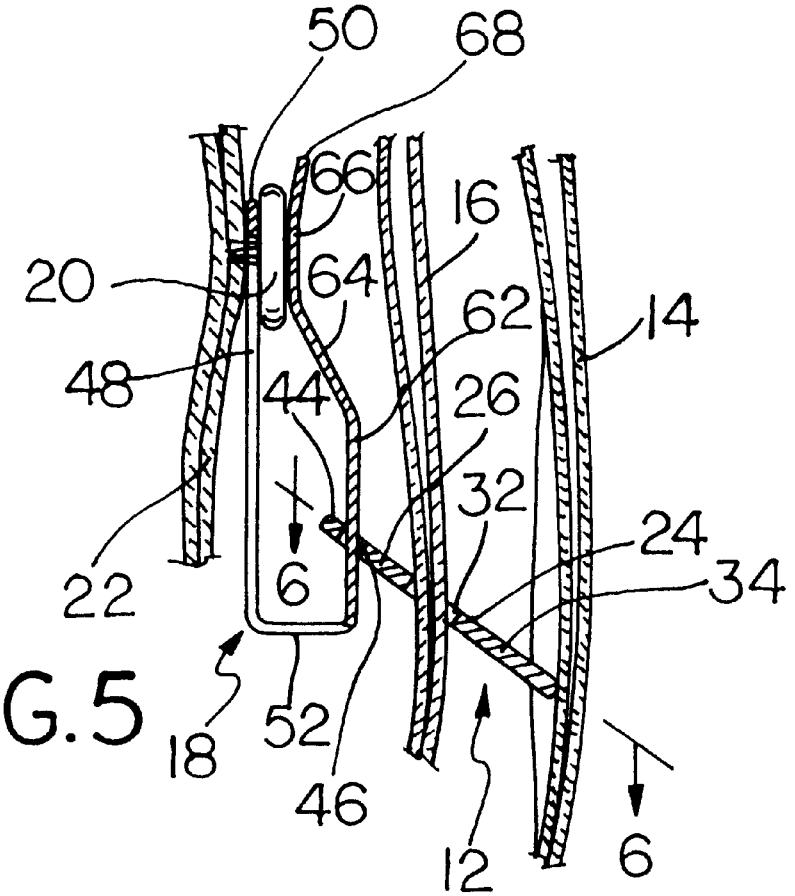
FIG. 5 is a fragmented, side elevational view, shown partly in section, of a tie retaining device according to the present invention mounted to a shirt and retaining a tie.

In use, retainer clip 18 is attached to a selected button 20 of shirt 22 by sliding the retainer clip onto and behind the button. Retainer clip 18 is held against shirt 22 directly above button 20 and moved downwardly so that inlet portion 56 of button-receiving opening 55 shifts over the button 20. As retainer clip 18 is slid further downwardly, the threads attaching button 20 to shirt 22 travel along button-receiving opening 55 between constricting portion 60 to closed portion 58 as shown in FIGS. 1 and 5. When so positioned, third segment 66 of prong 54 engages button 20 and is biased toward button 20 by the resiliency of the material from which the prong is formed, such as metal, plastic, or the like. Retainer clip 18 is prevented from being accidentally lifted upwardly off of button 20 by the compressive engagement between third segment 66 and button 20 and by constricting portion 60 of button-receiving opening 55. Note that the configuration of opening 55 allows a range of positioning on button 20, and also allows retainer clip 18 to rotate about button 20.

Fastener part 12 is next attached to the rear of the main tie body 14 at a location corresponding to the location of retainer clip 18 when the tie hangs in its normal position. Fastener part 12 is attached by inserting prongs 36, 38 through folded back, rear flaps 11, 13 of tie body 14. Fastener part 12 is attached in perpendicular relationship to the length of tie body 14 so that narrow opening 32 is positioned to receive tie tail 16. After tie tail 16 is threaded through narrow opening 32 (as indicated by the solid direction arrow in FIG. 1), eyelet 44 is slid onto prong 54 (as suggested by the dotted direction arrow in FIG. 1). The out-turned fourth segment 68 of prong 54 is threaded into eyelet opening 46. As eyelet 44 is shifted downwardly onto prong 54, eyelet 44 forces third segment 66 to separate slightly from button 20 against the biasing force of prong 54. Eyelet 44 slides over second segment 64 and is held in a retained position on first segment 62 of prong 54 as shown in FIG. 5.

Figure 6:
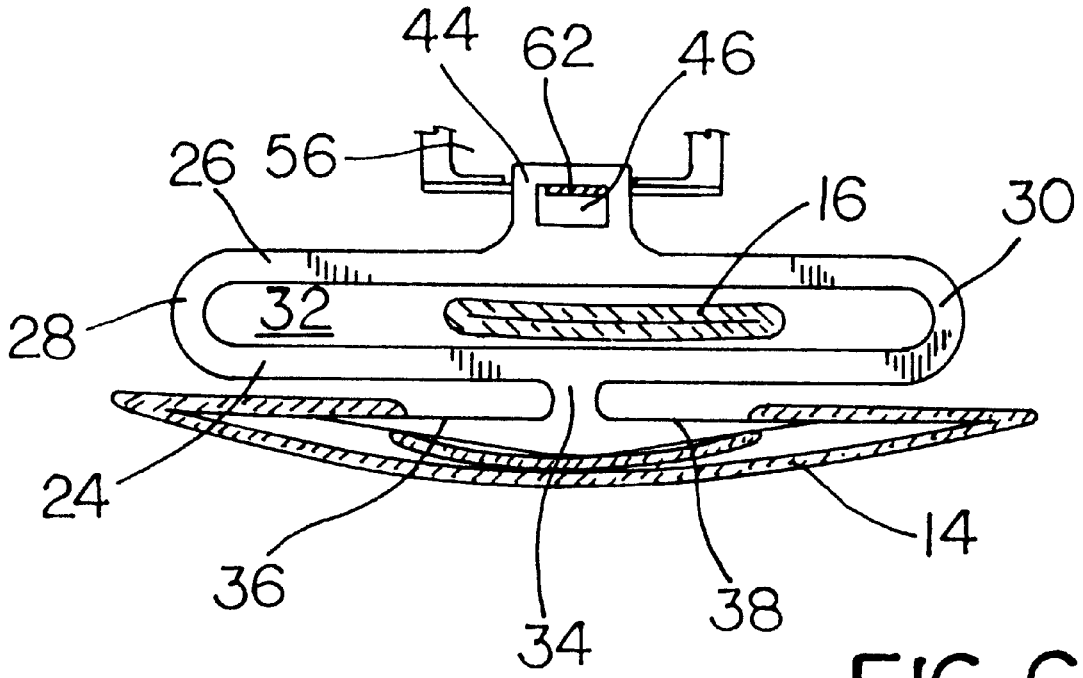
FIG. 6 is a fragmented cross-sectional view taken substantially along line 6—6 of FIG. 5.

Once threaded onto prong 54, eyelet 44 is prevented from accidentally shifting upwardly off of prong 54 by the compressive engagement between third segment 66 of prong 54 and button 20. As best shown in FIGS. 5 and 6, tie tail 16 is held adjacent tie body 14 by narrow opening 32, and the entire tie assembly is held in a substantially stationary position relative to button 20 by the interlocking connection between prong 54 and eyelet 44.

Figure 7:
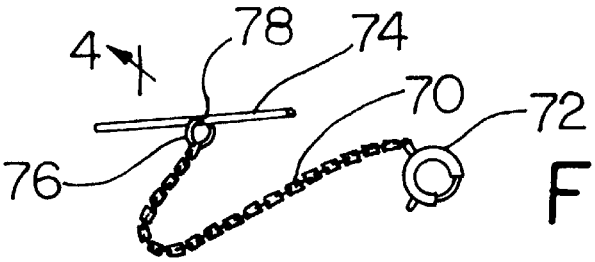
FIG. 7 is a perspective view of a retainer chain according to the present invention.

FIG. 7 shows a retainer chain 70 which may be substituted for retainer clip 18 in an alternate embodiment of the present invention. Retainer chain 70 includes a conventional clasp 72 on one end having a retractable locking hook and a rod 74 on the other end. Rod 74 is connected to chain 70 by link 76 which is threaded through a bore 78 located at the center of rod 74.

Retainer chain 70 is removably connected to shirt 22 by inserting rod 74 through a button hole in the shirt (not shown). The length of rod 74 and the central connection location of link 76 effectively prevent rod 74 from slipping through the button hole during normal wear. Clasp 72 is then attached to eyelet 44 in the standard fashion. Consequently, tie 14 and tie tail 16 are retained adjacent shirt 22, but some movement of the tie is permitted by the length of chain 70.

Figure 8:
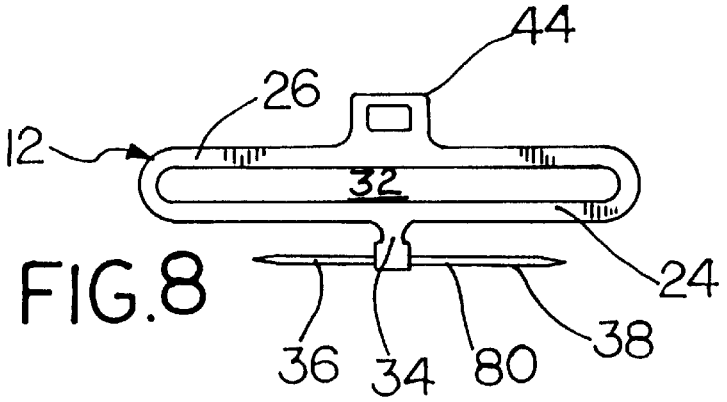
FIG. 8 is a top plan view of another embodiment of a fastener part according to the present invention.

FIG. 8 shows an alternate embodiment of fastener part 12 wherein barbs 36, 38 are replaced by a double-pointed pin 80 attached to arm 34 such as by welding or a compressive attachment wherein arm 34 is folded back onto itself around pin 80. As should be apparent from the figure, pin 80 is connected to arm 34 at a point offset from the center of pin 80. In the embodiment shown, one side of pin 80 (which constitutes barb 38) is approximately one-third longer than the other side of pin 80 (which constitutes barb 36). These length proportions make it easier to attach fastener part 12 to folded back flap portions 11, 13 of tie body 14. The longer end 38 of pin 80 is first inserted into one flap portion, and more readily remains threaded into that flap portion due to its length as fastener part 12 is shifted in the opposite direction so that the other end 36 of pin 80 threads into the other flap portion. Once attached to the tie, this embodiment is coupled to retainer part 18 in the manner described above.

While this invention has been described as having exemplary embodiments, this application is intended to cover any variations, uses, or adaptations of the invention using its general principles. Further, this application is intended to cover such departures from the present disclosure as come within the known or customary practice within the art to which it pertains. The spirit and scope of the invention are to be limited only by the terms of the appended claims.

What is claimed is:

1. A tie retaining device, comprising:

a fastener part having a front side and a back side;

a pair of barbs attached to the front side;

an eyelet attached to the back side; and a retainer clip including a rear part and a prong for removably coupling with the eyelet, the rear part including a button-receiving opening.

2. The device of claim 1 wherein the button-receiving opening has an inlet portion at a lower end and a closed portion at an upper end, the prong including a first segment adjacent the rear part and a second segment spaced away from the rear part.

3. The device of claim 2 wherein the button-receiving opening has a constricting portion between the upper end and the lower end.

4. The device of claim 2 wherein the retainer clip is of one-piece construction, the first segment of the prong being disposed adjacent the closed portion of the button-receiving opening, the second segment of the prong being disposed adjacent the inlet portion of the button-receiving opening.

5. The device of claim 2 wherein the first segment of the prong includes an out-turned segment which diverges away from the retainer clip back part.

6. The device of claim 1 wherein the barbs extend in opposite directions along the fastener part front side.

7. The device of claim 1 wherein one of the barbs is longer than the other barb.

8. The device of claim 1 wherein the front side is connected to the back side by a pair of end segments, thereby forming an elongated opening.

9. The device of claim 1 wherein the barbs are substantially centered on the front side and the eyelet is substantially centered on the back side.

10. A tie retaining device, comprising:

a fastener part having a front side and a back side;

a pair of opposed, laterally projecting barbs attached to the front side;

an eyelet attached to the back side; and a retainer chain having a clasp on one end for removably coupling with the back side eyelet and a rod on the other end.

11. The device of claim 10 wherein one barb is approximately one-third longer than the other barb.

12. The device of claim 10 wherein the fastener part includes a pair of end segments connecting the front and back sides, the front and back sides and the end segments defining a narrow opening.

13. The device of claim 12 wherein the barbs and the eyelet are substantially centered between the end segments.

14. The device of claim 10 wherein each of the barbs has a first end and a second end, the first ends being connected to one another.

15. The device of claim 14 further comprising an arm connected between the fastener part front side and the first ends of the barbs, thereby supporting the barbs in substantially parallel relationship to the front side.

16. A tie retaining device, comprising:

a fastener part having a front side and a back side;

a pair of barbs attached to the front side;

an eyelet attached to the back side;

a retainer clip including a rear part and a prong for removably coupling with the eyelet, the rear part including a button-receiving opening; and a retainer chain having a clasp on one end for removably coupling with the eyelet and a rod on the other end, the retainer chain and the retainer clip interchangeably providing coupling between the fastener part and a shirt.

17. The device of claim 16 wherein the front side is connected to the back side by a pair of end segments, thereby forming an elongated opening.

18. The device of claim 17 wherein the barbs and the eyelet are substantially centered between the end segments.

19. The device of claim 16 wherein each of the barbs includes a first and a second end, the first ends being connected to one another.

20. The device of claim 19 further comprising an arm connected between the front side and the first ends of the barbs.

21. The device of claim 16 wherein one of the barbs is longer than the other barb.

22. A tie retaining device, comprising:

a fastener part for removably connecting to a tie; and a retainer clip including a rear part and a prong for removably connecting to the fastener part, the rear part including a button receiving opening.

23. The device of claim 22 wherein the button receiving opening has an inlet portion at a lower end and a closed portion at an upper end, the prong including a first segment adjacent the rear part and a second segment spaced away from the rear part.

24. The device of claim 23 wherein the button receiving opening has a constricting portion between the upper end and the lower end.

25. The device of claim 23 wherein the retainer clip is of one piece construction, the first segment of the prong being disposed adjacent the closed portion of the button receiving opening, the second segment of the prong being disposed adjacent the inlet portion of the button receiving opening.

26. The device of claim 23 wherein the first segment of the prong includes an outturned segment which diverges away from the retainer clip rear part.

27. A tie retaining device, comprising:

a fastener part for removably connecting to a tie;

a retainer clip including a rear part and a prong for removably connecting to the fastener part, the rear part including a button receiving opening; and a retainer chain having a clasp on one end for removably connecting to the fastener part and a rod on the other end, the retainer chain and the retainer clip being used interchangeably to connect the fastener part to a shirt.

28. The device of claim 27 wherein the button receiving opening has an inlet portion at a lower end and a closed portion at an upper end, the prong including a first segment adjacent the rear part and a second segment spaced away from the rear part.

29. The device of claim 28 wherein the button receiving opening has a constricting portion between the upper end and the lower end.

30. The device of claim 28 wherein the retainer clip is of one piece construction, the first segment of the prong being disposed adjacent the closed portion of the button receiving opening, the second segment of the prong being disposed adjacent the inlet portion of the button receiving opening.

31. The device of claim 28 wherein the first segment of the prong includes an outturned segment which diverges away from the retainer clip rear part.

32. A tie retaining device, comprising:

a fastener part for connecting to a tie; and a one-piece retainer clip including a rear part for removably connecting to a shirt, the rear part including a button receiving opening having an inlet portion at a lower end and a closed portion at an upper end, and a prong for removably connecting to the fastener part, the prong including a first segment disposed adjacent the closed portion of the button receiving opening and adjacent the rear part, and a second segment spaced away from the rear part and disposed adjacent the inlet portion of the button receiving opening.

33. The device of claim 32 wherein the button receiving opening has a constricting portion between the upper end and the lower end.

34. The device of claim 32 wherein the first segment of the prong includes an outturned segment which diverges away from the retainer clip back part.

* * * * *